US008044751B2

(12) United States Patent
Tsai et al.

(10) Patent No.: US 8,044,751 B2
(45) Date of Patent: Oct. 25, 2011

(54) SWITCHABLE BANDPASS FILTER HAVING STEPPED-IMPEDANCE RESONATORS LOADED WITH DIODES

(75) Inventors: Zuo-Min Tsai, Taipei (TW); Shih-Fong Chao, Taipei (TW); Huei Wang, Taipei (TW)

(73) Assignee: National Taiwan University, Taipei (TW)

( * ) Notice: Subject to any disclaimer, the term of this patent is extended or adjusted under 35 U.S.C. 154(b) by 269 days.

(21) Appl. No.: 12/218,905

(22) Filed: Jul. 18, 2008

(65) Prior Publication Data

US 2010/0013576 A1 Jan. 21, 2010

(51) Int. Cl.
*H01P 1/203* (2006.01)
*H01P 7/08* (2006.01)

(52) U.S. Cl. ..... 333/205; 333/235

(58) Field of Classification Search ..... 333/167, 333/168, 174–176, 185, 202, 204, 205, 100, 333/101, 103, 104, 132, 134, 235
See application file for complete search history.

(56) References Cited

U.S. PATENT DOCUMENTS 7,117,025 B2 * 10/2006 Shih et al. ..... 505/210
2007/0200651 A1 * 8/2007 Kawai et al. ..... 333/205

* cited by examiner

*Primary Examiner* — Benny Lee
*Assistant Examiner* — Gerald Stevens
(74) *Attorney, Agent, or Firm* — Steven M. Jensen; Peter F. Corless; Edwards Angell Palmer & Dodge LLP

(57) ABSTRACT

A switchable bandpass filter includes a first stepped-impedance resonator, a second stepped-impedance resonator wirelessly coupled to the first stepped-impedance resonator, and a first diode connected to one end of the second stepped-impedance resonator.

2 Claims, 7 Drawing Sheets

| | | | ON-state | | | | OFF-state | | | |
|---|---|---|---|---|---|---|---|---|---|---|
| | $Z_{02}/Z_{01}$ | $\theta_1/(\theta_1+\theta_2)$ | $f_0$ | $f_1$ | $f_2$ | $f_3$ | $f_0$ | $f_1$ | $f_2$ | $f_3$ |
| R1 | 23/62 | 0.78 | 1.50 | 3.45 | 5.43 | 7.16 | 1.50 | 3.45 | 5.43 | 7.16 |
| R2 | 32/54 | 0.72 | 1.50 | 3.28 | 4.94 | 6.36 | 0.71 | 2.44 | 4.25 | 5.75 |
| R3 | 72/28 | 0.48 | 1.50 | 3.04 | 4.48 | 6.04 | 1.50 | 3.04 | 4.48 | 6.04 |
| R4 | 38/72 | 0.27 | 1.50 | 2.61 | 4.09 | 5.67 | 0.59 | 2.12 | 3.75 | 5.02 |

FIG. 7

| | | | ON-state | | | | OFF-state | | | |
|---|---|---|---|---|---|---|---|---|---|---|
| | $Z_{02}/Z_{01}$ | $\theta_1/(\theta_1+\theta_2)$ | $f_0$ | $f_1$ | $f_2$ | $f_3$ | $f_0$ | $f_1$ | $f_2$ | $f_3$ |
| R1 | 22/78 | 0.72 | 1.50 | 3.72 | 5.57 | 6.81 | 1.50 | 3.72 | 5.57 | 6.81 |
| R2 | 37/62 | 0.72 | 1.50 | 4.95 | 6.39 | 8.00 | 0.72 | 2.48 | 4.32 | 5.82 |
| R3 | 72/31 | 0.61 | 1.50 | 2.43 | 4.09 | 5.31 | 0.80 | 1.89 | 3.05 | 4.63 |
| R4 | 44/72 | 0.28 | 1.50 | 2.71 | 5.77 | 7.01 | 0.63 | 2.19 | 3.80 | 5.14 |

FIG. 9

SWITCHABLE BANDPASS FILTER HAVING STEPPED-IMPEDANCE RESONATORS LOADED WITH DIODES

BACKGROUND OF THE INVENTION

1. Field of the Invention

The present invention relates generally to bandpass filters, and more particularly, to a switchable bandpass filter having stepped-impedance resonators loaded with diodes.

2. Description of Related Art

A microwave switch is one of the most dominant building blocks in a radio-frequency (RF) front-end for time-division duplexing (TDD) communication systems. Recently, several works using passive field-effect transistors (FET) or p-i-n diodes have been reported for microwave and millimeter-wave transceiver applications (referring to F. J. Huang et al., "A 0.5 μm CMOS T/R switch for 900-MHz wireless applications", *IEEE J. Solid-State Circuits*, vol. 36, no. 3, pp. 486-492, March 2001; C. Tinella et al., "A high-performance CMOS-SOI antenna switch for the 2.5-5-GHz band", *IEEE J. Solid-State Circuits*, vol. 38, no. 7, pp. 1279-1283, July 2003; Z. Li et al., "15-GHz fully integrated nMOS switches in a 0.13-μm CMOS process", *IEEE J. Solid-State Circuits*, vol. 40, no. 11, pp. 2323-2328, November 2005; J. Kim et al., "A high-performance 40-85 GHz MMIC SPDT switch using FET-integrated transmission line structure", *IEEE Microw. Wireless Compon. Lett.*, vol. 13, no. 12, pp. 505-507, December 2003; K. Y. Lin et al., "Millimeter-wave MMIC passive HEMT switch using traveling-wave concept", *IEEE Trans. Microw. Theory Tech.*, vol. 52, no. 8, pp. 1798-1808, August 2004). Most of these switches are based on wideband design, implying that their operating bandwidths are over 50% and cannot provide sharp cutoff outside the operating band. Such a wideband switch shows poor band selectivity for system applications. Therefore, a bandpass filter is needed to be cascaded with a switch to reject out-of-band signals. Planar filters are popular in millimeter-wave filter designs because they are easily fabricated using printed circuit technology and integrated with other circuit components. However, conventional design of planar filters suffers from spurious responses in the upper stopband due to the nature of distributed elements (referring to S. B. Cohn, "Parallel coupled transmission-line resonator filters", *IRE Trans. Microw. Theory Tech.*, vol. MTT-6, no. 2, pp. 223-231, April 1958; E. G. Cristal et al. "Hairpin-line and hybrid hairpin-line/half-wave parallel-coupled-line filters", *IEEE Trans. Microw. Theory Tech.*, vol. MTT-20, no. 11, pp. 719-728, November 1972). Therefore, several techniques have been proposed to resolve this problem (referring to J. G. Garca et al. "Spurious passband suppression in microstrip coupled line bandpass filters by means of split ring resonators", *IEEE Microw. Wireless Compon. Lett.*, vol. 14, no. 9, pp. 416-418, September 2004; T. Lopetegi et al., "Microstrip wigglyline bandpass filters with multispurious rejection", *IEEE Microw. Wireless Compon. Lett.*, vol. 14, no. 11, pp. 531-533, November 2004; K. F. Chang et al., "Miniaturized cross-coupled filter with second and third spurious responses suppression", *IEEE Microw. Wireless Compon. Lett.*, vol. 15, no. 2, pp. 122-124, February 2005; P. Cheong et al., "Miniaturized parallel coupled-line bandpass filter with spurious-response suppression", *IEEE Trans. Microw. Theory Tech.*, vol. 53, no. 5, pp. 1810-1816, May 2005; C. F. Chen et al., "Design of microstrip bandpass filters with multiorder spurious-mode suppression", *IEEE Trans. Microw. Theory Tech.*, vol. 53, no. 12, pp. 3788-3793, December 2005; S. C. Lin et al., "Wide-stopband microstrip bandpass filters using dissimilar quarter-wavelength stepped-impedance resonators", *IEEE Trans. Microw. Theory Tech.*, vol. 54, no. 3, pp. 1011-1018, March 2006).

From the above discussion, a switchable bandpass filter that integrates the functions of a bandpass filter and a switch is desired to perform a bandpass filter function with wide stopband extension in the ON state and provide a good isolation while in the OFF state. T. S. Martin et al. develop a ring resonator loaded with a p-i-n diode as a switchable filter (referring to "Theoretical and experimental investigation of novel varactor-tuned switchable microstrip ring resonator circuits", *IEEE Trans. Microw. Theory Tech.*, vol. 36, no. 12, pp. 1733-1739, December 1988). By mounting the p-i-n diodes across the gap at 90 degrees from the feed point, the odd modes can be switched according to different bias conditions to control the ON and OFF states. However, it occupied a large layout size, and a high-order implementation is difficult. Y. H. Shu et al. present a coplanar waveguide-slotline switchable filer, in which p-i-n diodes are mounted over the end of the open stubs to make the circuit switchable (referring to "Electronically switchable and tunable coplanar waveguide-slotline bandpass filters", *IEEE Trans. Microw. Theory Tech.*, vol. 39, no. 3, pp. 548-554, March 1991). J. Lee et al. propose a switchable microstrip bandpass filter based on quarter-wavelength short-stub structures (referring to "A bandpass filter-integrated switch using field-effect transistors and its power analysis", *IEEE MTT-S Int. Microw. Symp. Dig.*, June 2006). The quarter-wavelength resonators were replaced by inductive short-stubs shunt with passive FETs to make it switchable. However, these previously mentioned designs mainly focus on designing the performance around the passbands, meaning that only the ON-state filter response and OFF-state isolation in the vicinity of the center frequency were considered. Consequently, those designs would suffer from unwanted spurious response and narrowband isolation in the ON and OFF states, respectively.

SUMMARY OF THE INVENTION

Accordingly, the objective of the present invention is to provide a switchable bandpass filter having stepped-impedance loaded with diodes, to solve the above mentioned problems.

In order to attain the above and other objectives, the switchable bandpass filter according to the present invention includes a first stepped-impedance resonator, a second stepped-impedance resonator wirelessly coupled to the first stepped-impedance resonator, and a first diode connected to one end of the second stepped-impedance resonator.

BRIEF DESCRIPTION OF DRAWINGS

FIG. 7 lists the impedances and the stepped length ratios of the resonators of the fourth-order switchable bandpass filter shown in FIG. 5;

FIG. 9 lists the impedances and the stepped length ratios of the resonators of the fourth-order switchable bandpass filter shown in FIG. 8;

DETAILED DESCRIPTION OF PREFERRED EMBODIMENTS

The following illustrative embodiments are provided to illustrate the disclosure of the present invention, these and other advantages and effects can be apparent to those skilled in the art after reading the disclosure of this specification.

Figure 1:
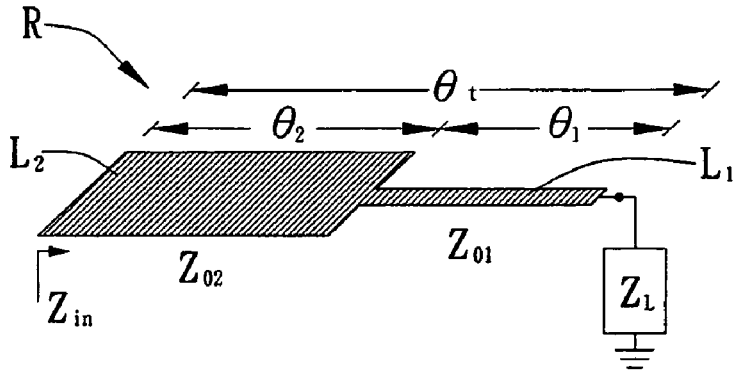
FIG. 1 shows the circuit structure of a stepped-impedance resonator loaded with a load at one end.

FIG. 1 shows the circuit structure of a stepped-impedance resonator R loaded with a load $Z_L$ at one end. The stepped-impedance resonator R is composed of two transmission lines $L_1$ and $L_2$ of different line widths. The load $Z_L$ is connected to one end of the transmission line $L_1$. If the input impedance of the stepped-impedance resonator R seen from the open end (i.e. from $L_2$ to $L_1$) is defined as $Z_{in}$, the parallel resonance of the stepped-impedance resonator R occurs when $1/Z_{in}=Y_{in}=0$, and the resonance condition may be written as $$Z_{01}(Z_{02}-Z_{01}\tan\theta_1\tan\theta_2)+j(Z_{02}\tan\theta_1+Z_{01}\tan\theta_2)=0 \quad (1),$$

where $Z_{01}$ and $Z_{02}$ are the characteristic impedances of the two transmission lines $L_1$ and $L_2$, and $\theta_1$ and $\theta_2$ are the electrical lengths of the two transmission lines $L_1$ and $L_2$, respectively.

By defining the stepped length ratio $\alpha$ of the stepped-impedance resonator R as $$\alpha=\frac{\theta_1}{\theta_1+\theta_2}=\frac{\theta_1}{\theta_t} \quad (2)$$

equation (1) can be rewritten as $$Z_{02}[Z_{01}+jZ_L\tan(\alpha\theta_t)]+jZ_{01}[Z_L+jZ_{01}\tan(\alpha\theta_t)]\tan(1-\alpha)\Big|_{\theta_t=0} \quad (3).$$

Figure 2:
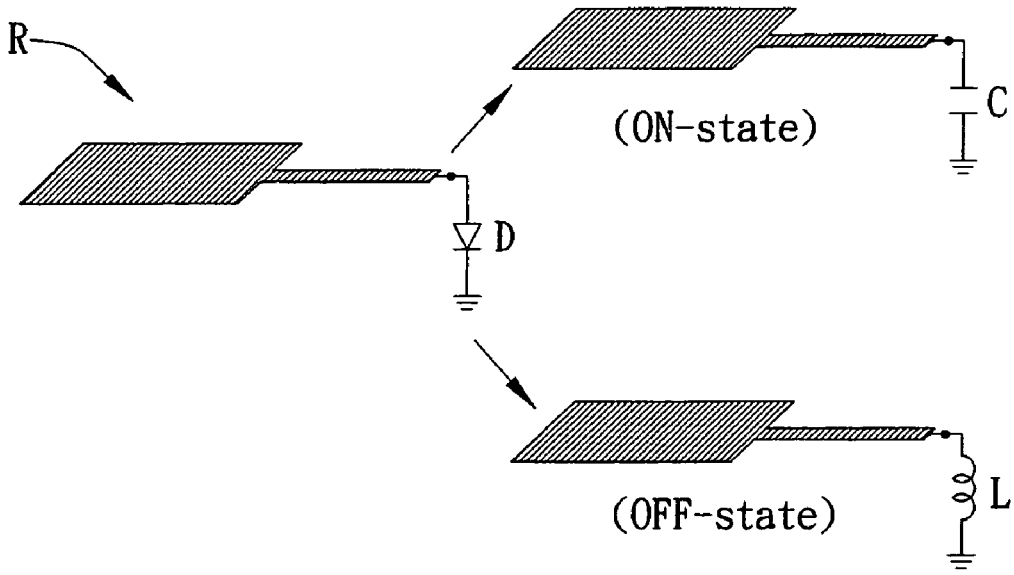
FIG. 2 shows the circuit structure of a stepped-impedance resonator loaded with a diode at one end.

In the present invention, the load $Z_L$ of the stepped-impedance resonator R is replaced by a p-i-n diode D, as shown in FIG. 2. When the diode D is reverse-biased (ON state), the diode D is equivalent to a junction capacitor C, and the stepped-impedance resonator R is loaded with the junction capacitor C. When the diode D is forward-biased, the diode D is equivalent to a parasitic inductor L, and the stepped-impedance resonator R is terminated by the parasitic inductor L. Therefore, the resonant frequencies of the stepped-impedance resonator R can be adjusted by applying different bias conditions to the diode D. In the following paragraphs, the resonance conditions of the stepped-impedance resonator R with different loads $Z_L$ (i.e. inductive or capacitive) will be analyzed and discussed to characterize the resonance phenomenon.

A. Capacitive Load

Applying $Z_L=-jX_C$ to equation (3) yields $$Z_{02}[Z_{01}+X_C\tan(\alpha\theta_t)]+Z_{01}[X_C-Z_{01}\tan(\alpha\theta_t)]\tan(1-\alpha)\Big|_{\theta_t=0} \quad (4).$$

From equation (4), it is observed that the resonance condition depends on the stepped length ratio $\alpha$, the impedances $Z_{01}$ and $Z_{02}$, and the loaded capacitive reactance $X_C$.

Figure 3:
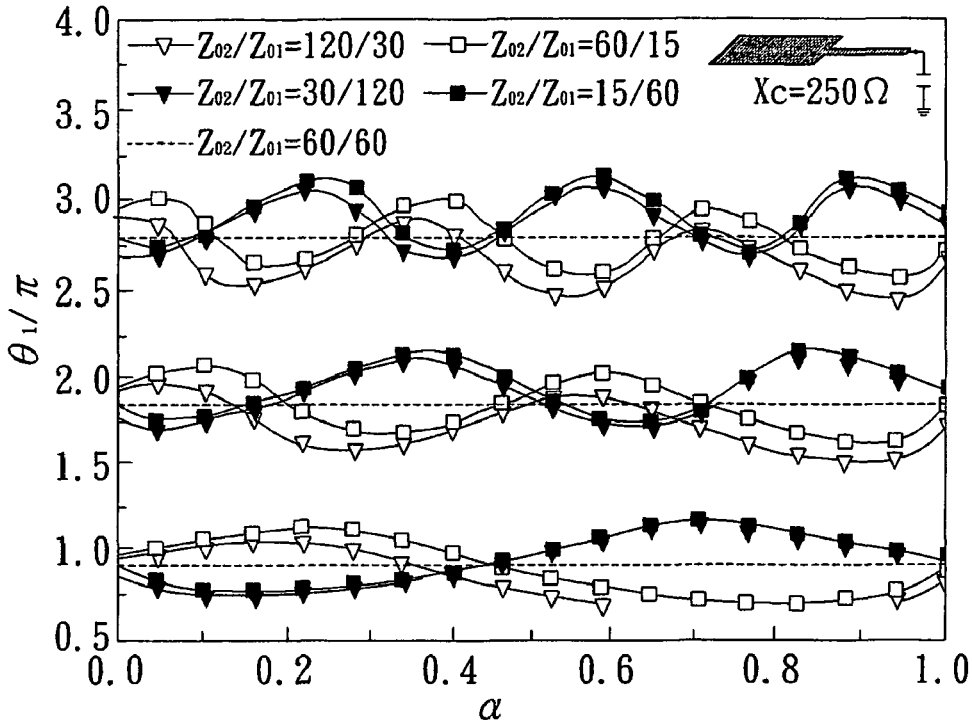
FIG. 3 shows resonant conditions for the stepped-impedance resonator loaded with a given capacitive load.

FIG. 3 shows resonant conditions for the stepped-impedance resonator 10, which is loaded with a given capacitive reactance $X_C$ (=250Ω). Note that the capacitive reactance $X_C$ is given at the first resonant frequency $f_0$. In FIG. 3, various resonant electrical lengths $\theta_t$ with respect to different transmission line impedance conditions for a given capacitive reactance (the load $Z_L$) are shown. The trends of these curves are similar to those of the resonators with the load $Z_L$ open-circuited, but the required electrical length $\theta_t$ for each resonance mode is reduced. This is because that the capacitive load C absorbs some electrical length of the open ended transmission line. In the uniform-impedance cases, the ratio of the nth resonant frequency to the fundamental frequency ($f_n/f_0$) is slightly greater than (n+1), and the ratio will increase as the transmission line impedances $Z_{01}$ and $Z_{02}$ increase or as the capacitive reactance $X_C$ decreases. In the stepped case, under a given capacitive load, one can keep a low-impedance transmission line longer than a high-impedance transmission line under $\alpha>0.5$, then the ratio of $f_n/f_0$ will be lower than that of its uniform impedance case. On the contrary, if the high-impedance transmission line is longer than the low-impedance transmission line, the ratio of $f_n/f_0$ will be greater than that of its uniform impedance case. It is also noted that, when the capacitance of the junction capacitor C is zero or $X_C=\infty$, the case will become stepped-impedance resonators with both ends opened.

B. Inductive Load

For inductive loads, i.e., $Z_L=jX_L$, equation (3) is reduced to $$Z_{02}[Z_{01}-X_L\tan(\alpha\theta_t)]-Z_{01}[X_L+Z_{01}\tan(\alpha\theta_t)]\tan(1-\alpha)\Big|_{\theta_t=0} \quad (5).$$

Figure 4:
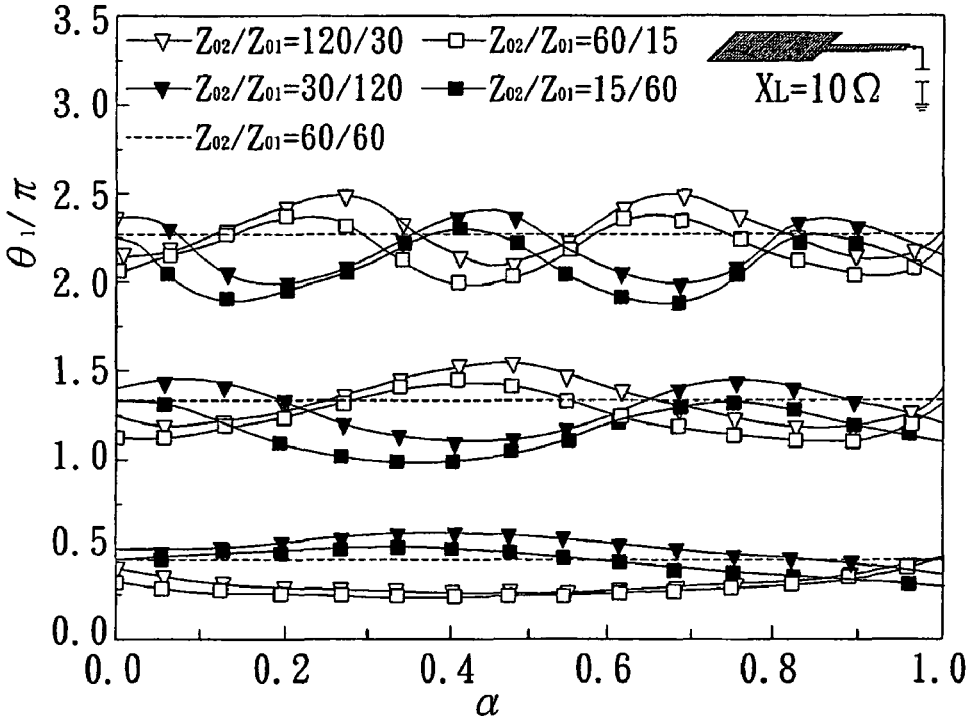
FIG. 4 shows resonant conditions for the stepped-impedance resonator loaded with a given inductive load.

FIG. 4 shows resonant conditions for the stepped-impedance resonator 10, which is loaded with a given inductive reactance $X_L$ (=10Ω). The inductive reactance $X_L$ is given at the first resonant frequency $f_0$. The trends of the curves are similar to those of the resonators with one end short-circuited, but the resonant electrical length needed for each resonance is decreased. Physically, the inductive load L absorbs some electrical length of the short-circuited transmission line. For a given inductive load, in the case when $Z_{01}=Z_{02}$, the ratio of the nth resonant frequency to the fundamental resonant frequency ($f_n/f_0$) is slightly larger than (2n+1). Also, the lower the transmission line impedances $Z_{01}$ and $Z_{02}$ are or the larger the inductive reactance $X_L$ is, the larger the ratio $f_n/f_0$ becomes. When $Z_{01}\neq Z_{02}$, for a fixed inductive load, the ratio of $f_n/f_0$ will be lower than that of its uniform-impedance case if the high-impedance transmission line is longer than the low-impedance transmission line under $\alpha<0.5$. On the contrary, the ratio of $f_n/f_0$ will be greater than that of its uniform-impedance case as the low-impedance transmission line is longer than the high-impedance transmission line. It is also noted that, when the inductance of the parasitic inductor L is zero or $X_L=0$, the case will become stepped-impedance resonators with both ends shorted to ground.

According to the above discussion, the stepped-impedance resonator R, if being loaded with the capacitor C, behaves like a half-wavelength resonator, or behaves like a quarter-wavelength resonator if being loaded with the inductor L. From equations (4) and (5), the resonance conditions are related to a few parameters. Therefore, there will be flexibility to arrange the resonant frequencies. For example, when a specific capacitive/inductive load is given, one can set the fundamental resonance to a specific frequency and keep the spurious frequencies away from other resonant frequencies of other resonators by properly adjusting the stepped length ratio $\alpha$ and the impedances $Z_{01}$ and $Z_{02}$ of the two transmission lines $L_1$ and $L_2$.

Figure 5:
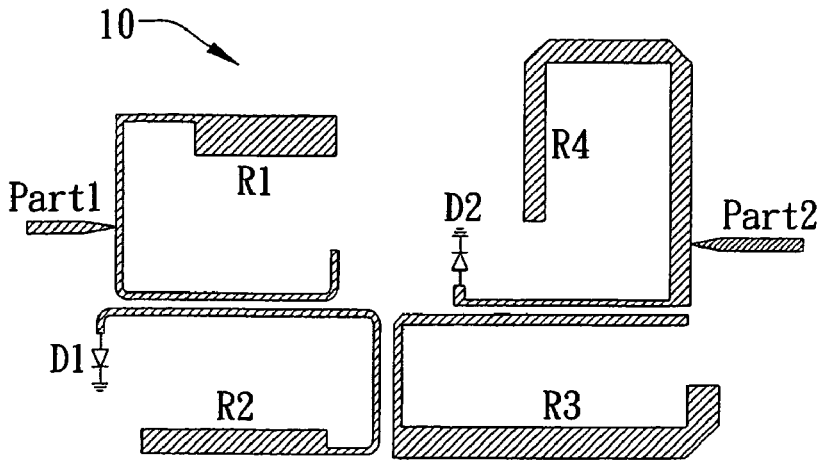
FIG. 5 is the circuit configuration of a fourth-order switchable bandpass filter of a first embodiment according to the present invention.

Please refer to FIG. 5, which is the circuit configuration of a fourth-order switchable bandpass filter 10 having four stepped-impedance resonators $R_1$-$R_4$ and two diodes $D_1$-$D_2$, of a first embodiment according to the present invention. The first stepped-impedance resonator $R_1$ is wirelessly coupled to the second stepped-impedance resonator $R_2$. The second stepped-impedance resonator $R_2$ is wirelessly coupled to the third stepped-impedance resonator $R_3$. The third stepped-impedance resonator $R_3$ is wirelessly coupled to the fourth stepped-impedance resonator $R_4$. The first diode $D_1$ is connected to one end of the second stepped-impedance resonator $R_2$. The second diode $D_2$ is connected to one end of the fourth stepped-impedance resonator $R_4$.

Figure 6:
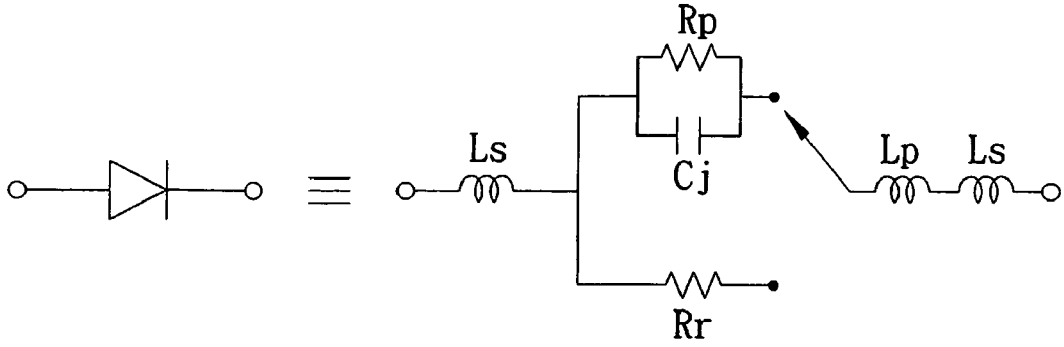
FIG. 6 is the equivalent circuit model of diodes of the fourth-order switchable bandpass filter shown in FIG. 5.

Please refer to FIG. 6, which is the equivalent circuit model of the diodes $D_1$ and $D_2$. Here, the Infineon's BAR65-02V p-i-n diode is used, with $L_P$=0.8 nH, $L_S$=0.1 nH, junction capacitor $C_j$=0.33 pF at −10V with reversed parallel resistance $R_p$=10 kΩ, and forward resistance $R_f$=1Ω under 1-mA biasing current.

Refer to FIG. 5 again. The diodes $D_1$ and $D_2$ are biased via 10-kΩ resistors. In the ON state (i.e. the diodes $D_1$ and $D_2$ are both reverse-biased), by properly adjusting the impedances and the stepped length ratios of the resonators $R_1$-$R_4$, as listed in FIG. 7, the resonators $R_1$-$R_4$ can be designed to have the same fundamental frequency while with staggered higher order spurious frequencies. As a consequence, the spurious passband of the switchable bandpass filter 10 is rejected. When the switchable passband filter 10 is turned off (i.e., the diodes $D_1$ and $D_2$ are both forward-biased), the equivalent terminated loads of the resonators $R_2$ and $R_4$ are changed from capacitors to inductors, meaning that the resonance conditions of the diode-loaded resonators $R_2$ and $R_4$ are switched from half-wavelength resonators to quarter-wavelength resonators. Thus, under the same geometry structure, the first two resonant frequencies will move from around 1 and 2 times to near 0.5 and 1.5 times the center frequency. Moreover, the resonant frequencies of the OFF state resonators are also designed to distribute irregularly over the band of interest to achieve wideband isolation.

Figure 8:
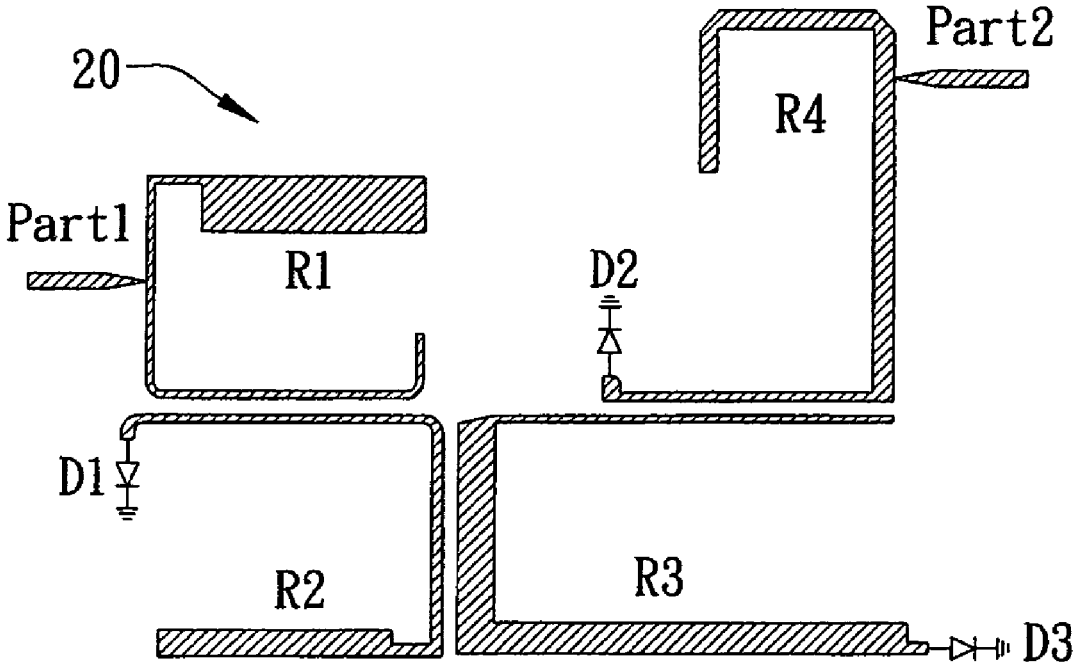
FIG. 8 is the circuit configuration of a fourth-order switchable bandpass filter of a second embodiment according to the present invention.

Please refer to FIG. 8, which is the circuit configuration of another fourth-order switchable bandpass filter 20 of a second embodiment according to the present invention. Similar to the switchable bandpass filter 10 shown in FIG. 5, the switchable bandpass filter 20 also includes the stepped-impedance resonators $R_1$-$R_4$ and the diodes $D_1$-$D_2$. Further, the switchable bandpass filter 20 has an additional diode $D_3$, which is connected to one end of the third stepped-impedance resonator $R_3$.

Similarly, by properly adjusting the impedances and the stepped length ratios of the resonators $R_1$-$R_4$, as listed in FIG. 9, the resonators $R_1$-$R_4$ can be designed to have the same fundamental frequency while with staggered higher order spurious frequencies.

Figure 10:
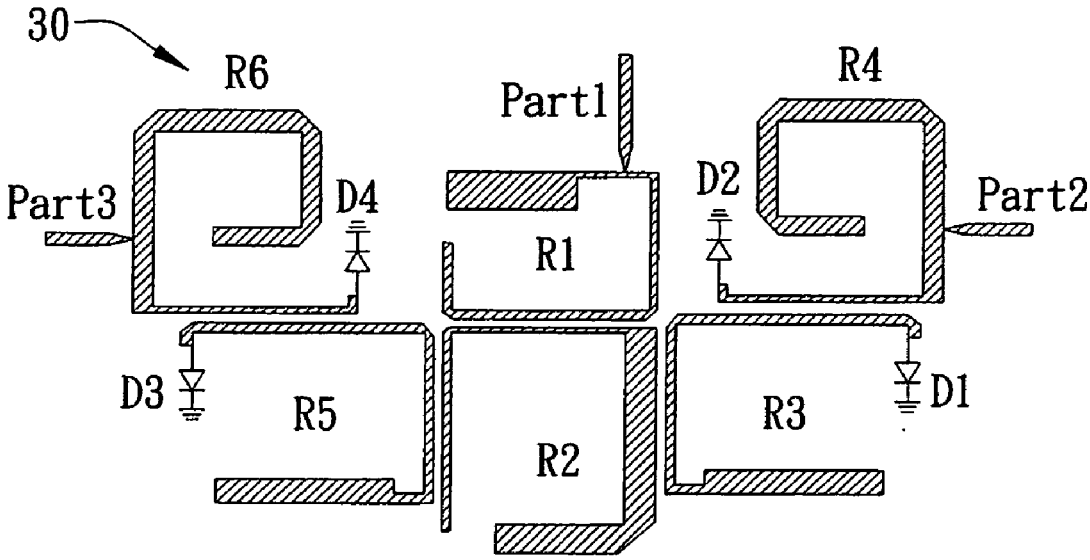
FIG. 10 is a single-pole-double-throw switchable bandpass filter of a third embodiment according to the present invention.

The switchable bandpass filters 10 and 20 is equivalent to a single-pole-single-throw (SPST) switch having bandpass filtering functionality. Please refer to FIG. 10, which is a single-pole-double-throw (SPDT) switchable bandpass filter 30 of a third embodiment according to the present invention. The SPDT switchable bandpass filter 30 comprises a first stepped-impedance resonator $R_1$, a second stepped-impedance resonator $R_2$ wirelessly coupled to the first stepped-impedance resonator $R_1$, a third stepped-impedance resonator $R_3$ wirelessly coupled to the second stepped-impedance resonator $R_2$, a first diode $D_1$ connected to one end of the third stepped-impedance resonator $R_3$, a fourth stepped-impedance resonator $R_4$ wirelessly coupled to the third stepped-impedance resonator $R_3$, a second diode $D_2$ connected to one end of the fourth stepped-impedance resonator $R_4$, a fifth stepped-impedance resonator $R_5$ wirelessly coupled to the second stepped-impedance resonator $R_2$, a third diode $D_3$ connected to the fifth stepped-impedance resonator $R_5$, a sixth stepped-impedance resonator $R_6$ wireless coupled to the fifth stepped-impedance resonator $R_5$, and a fourth diode $D_4$ connected to one end of the sixth stepped-impedance resonator $R_6$.

In operation, the diodes $D_1$ and $D_2$ receive a switching signal complementary to that received by the diodes $D_3$ and $D_4$. Therefore, when the resonators $R_1$, $R_2$, $R_3$ and $R_4$ combine to operate in the ON state (i.e., the diodes $D_1$ and $D_2$ are both reverse-biased), the resonators $R_1$, $R_2$, $R_5$ and $R_6$ combine to operate in the OFF state (i.e., the diodes $D_3$ and $D_4$ are both forward-biased).

In the SPDT switchable bandpass filter 30, two common resonators (i.e., the resonators $R_1$ and $R_2$) are utilized to reduce the number of total resonators. Actually, the number of common resonators equals the unloaded resonators used in each SPST switchable filter design. For example, if three common resonators are used in this SPDT design, the total number of resonators will be reduced to five, but the isolation performance will degrade due to the fact that there is only one switchable resonator in each signal path. On the contrary, if only one common resonator is used, the isolation performance can be improved with a tradeoff for the circuit size and passband insertion loss.

The switchable bandpass filters 10, 20 and 30 are all fourth-order. However, a switchable bandpass filter of the present invention can be lower-order. For example, a switchable bandpass filter of the present invention can be designed to comprise a first stepped-impedance resonator, a second stepped-impedance resonator wirelessly coupled to the first stepped-impedance resonator, and a first diode connected to one end of the second stepped-impedance resonator to operate as an SPST switchable filter, or further to comprise a third stepped-impedance resonator wirelessly coupled to the first stepped-impedance resonator, and a second diode connected to one end of the third stepped-impedance resonator to operate as an SPDT switchable filter.

The present invention proposes a new concept to design electronically switchable filters using diode-loaded stepped-impedance resonators. Resonance conditions of stepped-impedance resonators with different loads at one end are also studied and discussed. The proposed switchable filters successfully integrate a bandpass filter and a switch into a single component and can combine both of their advantages. Besides the wide stopband rejection of the bandpass filter response in the ON state, high isolation performance is also obtained from dc to many octave bandwidth in the OFF state. Finally, a compact SPDT switchable filter using common resonators is also demonstrated to show its application is wireless communication systems. Although the design concept is demonstrated using hybrid circuits in this paper, the idea could also be easily applied to MMIC design for high-level integration.

The above-described descriptions of the detailed embodiments are only to illustrate the preferred implementation according to the present invention, and it is not to limit the scope of the present invention, Accordingly, all modifications and variations completed by those with ordinary skill in the art should fall within the scope of present invention defined by the appended claims.

What is claimed is:

1. A switchable bandpass filter having stepped-impedance resonators loaded with diodes, comprising:

a first stepped-impedance resonator;

a second stepped-impedance resonator wireles sly coupled to the first stepped-impedance resonator;

a third stepped-impedance resonator wirelessly coupled to the second stepped-impedance resonator;

a first diode connected to one end of the third stepped-impedance resonator;

a fourth stepped-impedance resonator wirelessly coupled to the third stepped-impedance resonator;

a second diode connected to one end of the fourth stepped-impedance resonator;

a fifth stepped-impedance resonator wireles sly coupled to the second stepped-impedance resonator;

a third diode connected to one end of the fifth stepped-impedance resonator;

a sixth stepped-impedance resonator wireles sly coupled to the fifth stepped-impedance resonator; and a fourth diode connected to one end of the sixth stepped-impedance resonator, wherein switching signals from the stepped-impedance resonators combine to guide an input signal to one of a plurality of output ports.

2. The switchable bandpass filter of claim 1, wherein at least one of the first, second, third, fourth, fifth and sixth stepped-impedance resonators comprises a first transmission line and a second transmission line connected to the first transmission line, the second transmission line being different from the first transmission line in thickness.

* * * * *